US005517795A

United States Patent [19]

Doke

[11] Patent Number: 5,517,795

[45] Date of Patent: May 21, 1996

[54] FURRING STUD ASSEMBLY FOR SLOTTED WALL

[76] Inventor: Jack Doke, 915 W. 20th St., Upland, Calif. 91784

[21] Appl. No.: 343,709

[22] Filed: Nov. 22, 1994

[51] Int. Cl.[6] ..... E04F 19/00

[52] U.S. Cl. ..... 52/36.4; 52/731.5; 52/731.9; 248/243

[58] Field of Search ..... 52/36.5, 36.4, 52/731.5, 731.9, 732.1, 732.2, 733.2, 241, 242, 741.14, 741.15, 36.6; 248/243, 221.2, 224.4

[56] References Cited

U.S. PATENT DOCUMENTS

| | | |
|---|---|---|
| 559,335 | 4/1896 | Kindl . |
| 2,076,472 | 2/1936 | London . |
| 2,356,309 | 5/1941 | Garbe . |
| 2,621,763 | 12/1952 | Buqour et al. . |
| 2,736,399 | 2/1956 | Spencer . |
| 3,243,930 | 4/1966 | Slowinski . |
| 3,305,981 | 2/1967 | Biggs et al. . |
| 3,394,507 | 7/1968 | Doke . |
| 3,407,547 | 10/1968 | Doke et al. . |
| 3,492,766 | 2/1970 | Andrews . |
| 3,509,669 | 5/1970 | Plemeng . |
| 3,562,970 | 2/1971 | Schwartz . |
| 3,565,152 | 2/1971 | Cohn . |
| 3,570,198 | 3/1971 | Ruhnke . . |
| 3,638,370 | 2/1972 | Miller . |
| 3,648,419 | 3/1972 | Marks . |
| 3,668,827 | 6/1972 | Schwartz . |
| 3,714,748 | 2/1973 | Costruba . |
| 3,730,477 | 5/1973 | Wavrunek . |
| 3,791,709 | 2/1974 | Cross . |
| 3,828,495 | 8/1974 | Law . |
| 3,848,364 | 11/1974 | Costruba . |
| 3,925,939 | 12/1975 | Costruba . |
| 4,010,591 | 3/1977 | Gross . |
| 4,037,379 | 7/1977 | Ozanne . |
| 4,370,838 | 2/1983 | Vermillion . |
| 4,441,300 | 4/1984 | Varon et al. . |
| 4,581,859 | 4/1986 | Doke et al. . |
| 4,588,156 | 5/1986 | Doke et al. . |
| 4,839,999 | 6/1989 | Clemens et al. . |
| 5,095,678 | 3/1992 | Murphy . |

*Primary Examiner*—Creighton Smith
*Attorney, Agent, or Firm*—Knobbe, Martens, Olson & Bear

[57] ABSTRACT

A furring stud assembly for mounting a new wall, shelving and/or other wall mounted objects, onto an existing wall structure. The assembly features a furring stud having an "M" shaped cross-section defining three longitudinal channels, and a slotted wall standard which is at least partially recessable into the central channel of the furring stud. The furring stud assembly is suitable for attachment directly to an existing wall, using conventional nails or screws. The furring stud and slotted wall standard are easily made from sheet metal by roll forming and/or stamping.

8 Claims, 2 Drawing Sheets

FURRING STUD ASSEMBLY FOR SLOTTED WALL

BACKGROUND OF THE INVENTION

This invention relates generally to the building industry, and more particularly to an improved furring stud assembly for installing a fixture display wall with recessed slotted standards on the face of an existing wall.

Various apparatus have been proposed for installing decorative panels, skins and coverings to modernize or improve the aesthetics of an existing wall, or to provide aesthetically pleasing mounting systems for wall shelving, mirrors, or the like, where there is an existing wall. Many systems require the demolition of the existing wall, and construction of a new wall with recessed mounting apparatus. Some systems have also been proposed to install new mounting apparatus on the existing wall, together with a series of panels to hide the mounting apparatus and existing wall from view. However, these latter systems (such as U.S. Pat. No. 4,370,838) have involved extruded aluminum upper and lower horizontal channel members having clips to hold extruded aluminum, horizontally spaced, vertical studs. These systems are relatively expensive to manufacture, and the apparatus have been complicated to fabricate and install, particularly when the assembly occurs on the construction site.

SUMMARY OF THE INVENTION

The present invention is a furring stud assembly for mounting a new wall, shelving and/or other wall mounted objects, onto an existing wall. The assembly comprises (1) a furring stud having an "M" shaped cross-section defining three longitudinal channels, and (2) a slotted wall standard which is at least partially recessable into the central channel of the furring stud. The central channel of the furring stud is sized to permit the insertion of (a) a nail or screw through the channel's back wall and into an underlying support structure, and thereafter (b) that portion of the slotted wall standard which is to be recessed behind the new wall. The back wall of each of the other two channels provides a convenient attachment surface for the slotted wall standard, as well as for a new wall section or panel to be hung onto the furring stud assembly. The furring stud assembly is suitable for attachment directly to the underlying support structure, using conventional attachments, such as nails or screws.

Each of the components of the furring stud assembly is easily and inexpensively manufactured from sheet metal by roll forming and/or stamping; complicated, extruded parts are avoided. Since there are multiple components in the assembly, each component may be manufactured from a different metal sheet (i.e., allowing different quality of metal and/or different metal thicknesses) so that each is best suited to that component's role. Yet the components are easily assembled on-site with conventional tools to form the furring stud assembly.

The invention makes it unnecessary to replace an existing wall in order to install a fixture display wall with recessed slotted standards. The furring stud assembly can be secured directly to the exposed face of an existing wall. The furring stud itself acts as a spacer between the existing wall and the fixture display wall, and the furring stud receives the slotted wall standard for supporting shelving (or other wall objects) through the slots in the slotted standards. Thus, the fixture display wall with recessed slotted standards can be installed with a minimal loss of space and with minimal expense using the present invention.

DESCRIPTION OF THE PREFERRED EMBODIMENTS

Figure 1:
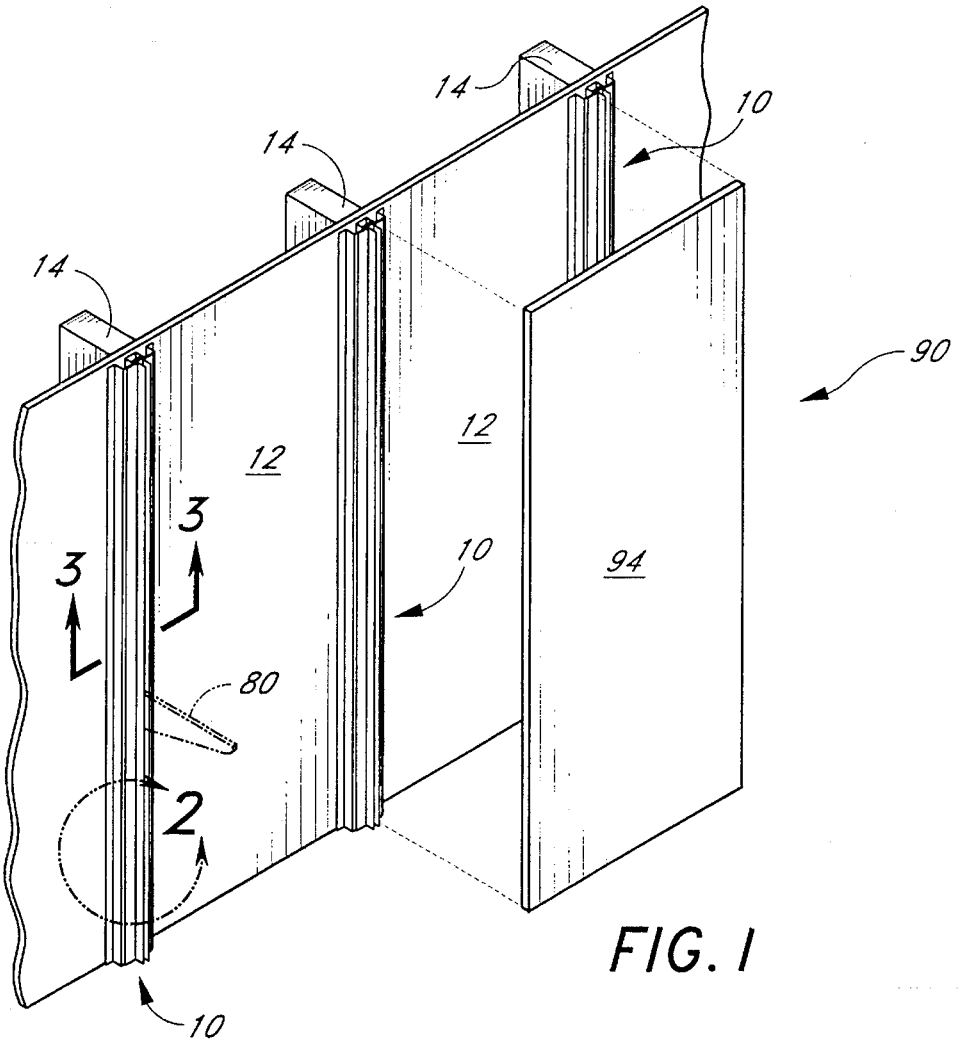
FIG. 1 is a perspective view showing a plurality of the furring stud assemblies of this invention as applied to an existing wall, in order to support a new fixture display wall with recessed slotted standards.

Referring to FIG. 1, the present invention provides a furring stud assembly (indicated generally by 10) for attachment to an existing wall 12 in order to support a fixture display wall with recessed slotted standards (indicated generally by 90) made up of a plurality of panels 94. Such fixture display walls are advantageously used to remodel and/or redecorate the interior vertical walls of a retail sales room or other merchandise display area, although it may be used with equal facility to decorate a newly constructed wall.

Figure 2:
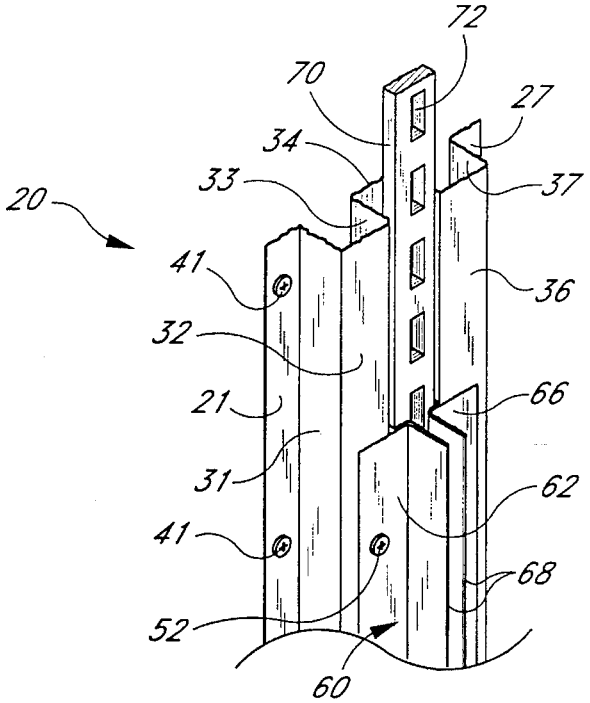
FIG. 2 is an enlarged, fragmentary perspective view of a portion of the furring stud assembly of this invention showing the different components of the assembly.
Figure 3:
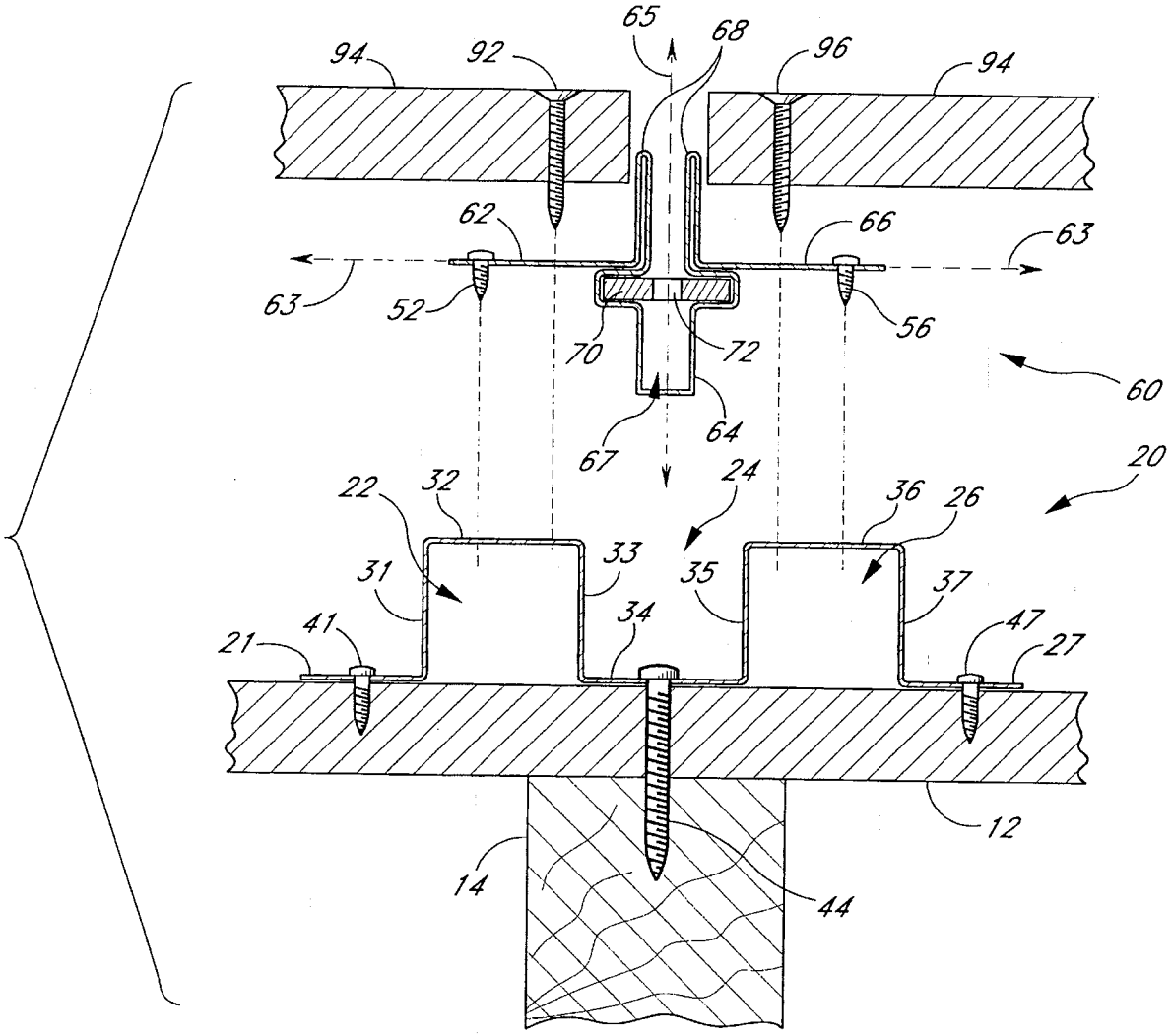
FIG. 3 is an exploded, horizontal, cross-sectional view of a furring stud assembly of this invention, taken along the section line 3—3 of FIG. 1.

The first component of furring stud assembly 10 is a furring stud (indicated generally by 20). As best seen in FIGS. 2 and 3, furring stud 20 has an "M" shaped cross-section formed from two flanges (21 and 27) and three side by side longitudinal channels (22, 24 and 26), each of which has a back wall (32, 34 and 36, respectively) and two side walls. Side wall 33 is shared by channels 22 and 24, and side wall 35 is shared by channels 24 and 26. Side wall 31 connects back wall 32 to flange 21; side wall 37 connects back wall 36 to flange 27. Preferably, furring stud 20 is formed from a single strip of sheet metal which is roll formed or stamped into the "M" shape defined by flange 21, side wall 31, back wall 32, side wall 33, back wall 34, side wall 35, back wall 36, side wall 37, and flange 27. Flanges 21 and 27 are coplanar with back wall 34, in order to facilitate attachment to existing wall 12. Main nail 44 (or other similar attachment device) is driven through back wall 34 of channel 24, and through wall 12 and into a stud 14 or a horizontal flat strap. Optionally, screws 41 and 47 (or other similar attachment devices) may be driven through flanges 21 and 27, respectively, and into such wall 12 or horizontal flat strap.

The second component of furring stud assembly 10 is a slotted wall standard (indicated generally by 60). One such slotted wall standard is marketed by Elite Standard Systems Mfg. Co., of Rancho Cucamonga, Calif., under the trademark "ELITE UNI-STANDARD." As best seen in FIG. 3, standard 60 has a cross-shaped cross-section, with coplanar flanges 62 and 66 extending outward in opposite directions, and a pair of longitudinally coextensive, horizontally spaced apart ribs 68 extending outward in a direction opposite recessed section 64. The common plane (63) of flanges 62 and 66 is preferably perpendicular to a plane (65) bisecting recessed section 64 and ribs 68. Recessed section 64 is sized so as to fit within channel 24 of furring stud 20, and flanges 62 and 66 are adapted to engage and be attached to back walls 32 and 36, respectively, of furring stud 20.

A third component of the furring stud assembly is bracket anchoring strip 70 or similar mounting bracket. Strip 70 is secured within a chamber 67 formed by the walls of recessed section 64 and has a plurality of perforations 72 vertically disposed along its length and adapted to receive and support conventional shelf brackets 80, or other wall mounting devices.

Referring again to FIG. 1, each of a plurality of furring stud assemblies 10 are installed vertically on wall 12 at horizontally spaced locations. Normally, the length of furring stud assemblies 10 will be selected to be the same distance as the height of wall 12, that is, they will extend from the floor (not shown) to the ceiling (not shown).

The installation of furring stud assembly 10 is straightforward. It is fastened in a secure manner to the existing wall by using nails, screws or bolts into the supporting studs or other means of firmly attaching it to the existing wall. In an exemplary installation, furring stud 20 is plumbed and positioned with back wall 34 of channel 24 lying against wall 12 opposite vertical stud 14. Nails 44 are driven through back wall 34 and through wall 12 and into stud 14. Slotted wall standard 60 is positioned abutting against furring stud 20, with recessed section 64 within channel 34, and with flanges 62 and 66 abutting against back walls 32 and 36, respectively, of furring stud 20. Each standard 60 is secured to its corresponding stud 20 by any suitable means, such as metal screws 52 and 56 extending through flanges 62 and 66, respectively, and through back walls 32 and 36, respectively.

Once furring stud assemblies 10 have been installed, wall 90 may be installed. Wall 90 is a fixture display wall with recessed slotted standards which comprises a plurality of wall panels 94 sized and positioned to extend between standards 60 such that the ends of each wall panel 94 abuts against opposite ribs (68) on adjacent slotted wall standards 60. Wall panels 94 are secured by driving screws 92 and 96 through panels 94, and through a flange (62 and 66, respectively) of standard 60, and into a back wall (32 and 36, respectively) of furring stud 20.

One of the advantages of this invention is that each component of the furring stud assembly may be manufactured separately, and less expensively, and more efficiently from sheet metal by roll forming or stamping. This also allows the manufacturer to separately select the appropriate metals and sheet thicknesses to fulfill the specific role for each component. For example, furring stud 10 may be made from a light, thin metal sheet (such as 26 to 20 gauge steel), whereas perforated strip 70, which may need to support cantilevered shelves or other heavy objects, may be made from a heavier, thicker metal sheet (such as 14 to 10 gauge steel). Standard 60 is typically made from 24 to 20 gauge steel. Metals with different performance characteristics may be used in combination. Therefore the invention provides both flexibility and simplicity in fabrication.

As to typical dimensions, furring stud 20 would preferably have a depth (i.e., out from the existing wall) of between about ¾ and about ⅞ inches, and most preferably not greater than ⅞ inch. Ribs 68 would be sized to match the thickness of the panels 94, which typically would be ½ inch, ⅝ inch, or 1 inch for wall boards or panels, or ¾ inch or 1 ¼ inch for mirrored panels.

It is understood that panels 94 may vary widely not only in width, but also in their appearance and composition. They may be formed from colored or mirrored glass, perforated peg boards, plain or slat surface plywood, sheet metal laminates, plaster board, or combinations of such materials. Similarly, the number and/or type of brackets 80 or other devices for mounting objects on wall 90 may be varied widely, with corresponding adjustments in the choice of perforations 72 in bracket anchoring strip 70.

While presently preferred embodiments of the invention have been illustrated and described in detail, it will be understood that various modifications in details of construction and design may be made without departing from the spirit of the invention or the scope of the following claims.

We claim:

1. A furring stud assembly comprising:

(a) a furring stud having an "M" shaped cross-section defining three longitudinal channels positioned side by side; and (b) a slotted wall standard having (i) two longitudinally coextensive, coplanar flange portions extending outwardly in opposite directions, and (ii) longitudinally coextensive, outward projecting panel-separating portions in a plane which is perpendicular to the plane of said flange portions, and (iii) an inward projecting section adapted to fit within a central channel of said furring stud;

(c) fasteners for attaching said slotted wall standard to said furring stud such that the flange portions of said standard engage respective walls of two outside channels of said furring stud; and (d) a bracket anchoring strip mounted within said inward projecting section of said slotted wall standard and adapted to receive and support one or more mounting brackets inserted through said panel-separating portions.

2. The furring stud assembly of claim 1 in which each of said furring stud and said slotted wall standard are formed from sheet metal by roll forming or stamping.

3. The furring stud assembly of claim 2 in which said furring stud is formed from sheet metal of between 26 and 20 gauge.

4. The furring stud assembly of claim 2 in which said slotted wall standard is formed from a sheet metal of between 24 and 20 gauge.

5. The furring stud assembly of claim 1 in which said bracket anchoring strip is formed from sheet metal of between 14 and 10 gauge.

6. A furring stud assembly, comprising:

(a) a furring stud formed from sheet metal of between 26 and 20 gauge, and having an "M" shaped cross-section defining first, second and third longitudinal channels positioned side by side, and having two outer flanges extending outwardly from the first and third channels, said flanges being coplanar with the back wall of the second channel; and (b) a slotted wall standard formed from sheet metal of between 24 and 20 gauge, and having (i) two longitudinally coextensive, coplanar flange portions extending outward in opposite directions and adapted to engage and be attached to the back walls of the first and third channels of said furring stud, and (ii) longitudinally coextensive panel-separating portions extending away from said furring stud in a plane which is perpendicular to the plane of said flange portions, and (iii) an inward projecting section adapted to fit within said second channel of said furring stud; and (c) a bracket anchoring strip mounted within said inward projecting section of said slotted wall standard and adapted to receive and support one or more mounting brackets inserted through said panel-separating portions; and (d) fasteners for attaching said slotted wall standard to said furring stud such that the flanges of said standard engage walls of the first and third channels of said furring stud.

7. The furring stud assembly of claim 6 wherein each of said furring stud, said slotted wall standard, and said anchoring strip are formed from sheet metal by roll forming or stamping.

8. A method for installing a wall fixture display over an existing wall having a plurality of vertical studs, comprising:

(a) positioning against said existing wall at horizontally spaced apart positions, a plurality of furring studs formed from sheet metal and having an "M" shaped cross-section defining first, second and third longitudinal channels positioned side by side; and (b) securing each of said furring studs to the corresponding one of said studs by driving a plurality of fasteners through the back wall of said second channel and into said stud; and (c) positioning in abutting relationship with each of said furring studs, a slotted wall standard formed from sheet metal and having an inward projecting section adapted to fit within said second channel of said furring stud; and (d) securing each of said slotted wall standards to the corresponding one of said furring studs by driving a plurality of fasteners through said standards and into the back walls of said first and third channels; and (e) positioning a plurality of wall panels in abutting relationship against and between adjacent pairs of said slotted wall standards; and (f) securing each of said wall panels to the corresponding pair of slotted wall standards by driving a plurality of fasteners through said wall panels, through at least a portion of said slotted wall standard, and into the back wall of the first or third channel of said furring studs.

* * * * *